United States Patent [19]

Ritter

[11] 4,413,670

[45] Nov. 8, 1983

[54] PROCESS FOR THE ENERGY-SAVING RECOVERY OF USEFUL OR AVAILABLE HEAT FROM THE ENVIRONMENT OR FROM WASTE HEAT

[75] Inventor: Alfred E. Ritter, Mülheim, Fed. Rep. of Germany

[73] Assignee: Studiengesellschaft Kohle mbH, Mülheim, Fed. Rep. of Germany

[21] Appl. No.: 268,970

[22] Filed: Jun. 1, 1981

[30] Foreign Application Priority Data

May 30, 1980 [DE] Fed. Rep. of Germany ..... 3020565

[51] Int. Cl.[3] ..... F28D 21/00

[52] U.S. Cl. ..... 165/1; 165/104.14; 165/104.12; 165/32

[58] Field of Search ..... 165/104.12, DIG. 17, 165/1, 32, 104.21, 104.14

[56] References Cited

U.S. PATENT DOCUMENTS

| | | | |
|---|---|---|---|
| Re. 18,665 | 11/1932 | Munters | 62/333 X |
| 2,044,951 | 6/1936 | Munters | 62/478 X |
| 4,039,023 | 8/1977 | McClaine | 165/104.12 X |
| 4,044,819 | 8/1977 | Cottingham | 165/104.12 X |
| 4,161,211 | 7/1979 | Duffy et al. | 165/104.12 X |

*Primary Examiner*—Albert W. Davis, Jr.

*Attorney, Agent, or Firm*—Sprung, Horn, Kramer & Woods

[57] ABSTRACT

A process for the energy-saving recovery of useful heat from the environment or from waste heat with the use of a reversible chemical reaction comprising, charging and discharging alternatingly and successively by pressure variation with hydrogen two vessels which are interconnected by lines and filled with a metal hydride and the hydride-forming metal and removing as useful heat the heat of compression and of hydride formation thereby liberated by heat exchange and replacing consumed heat of expansion and hydrogen evolution of the hydride by heat exchange with the environment or by waste heat.

12 Claims, 4 Drawing Figures

PROCESS FOR THE ENERGY-SAVING RECOVERY OF USEFUL OR AVAILABLE HEAT FROM THE ENVIRONMENT OR FROM WASTE HEAT

This invention relates to a process for the energy-saving recovery of useful or available heat from the environment or from waste heat with the use of a reversible chemical reaction. Moreover, the invention relates to an apparatus for carrying out this process.

BACKGROUND OF THE INVENTION

Various heat pumps are known which operate in accordance with the compression or absorption principle. In these heat pumps, readily vaporizable liquids having a low vapor pressure such as halohydrocarbons or ammonia are compressed mechanically or thermally until liquefaction begins, and the condensation heat of the particular working materials is obtained as heating energy or available heat. The available heat consists of the enthalpy of vaporization which is contributed by environmental energy and the compression heat originating from the mechanical or thermal drive. Thus, merely changes of the state of aggregation take place and chemical changes are avoided intentionally.

In compression heat pumps which are operated electrically, the performance numbers, i.e. the ratio of delivered available heat to expended auxiliary energy, range between 2 and 4. In absorption type heat pumps which are basically operated with fossil energy, this number is about 1.3. As compared herewith, an oil or gas heating boiler has a performance number of about 0.8.

Due to the general energy shortage, interest was recently attracted also by thermochemical heat pumps where utilization of the absorption or output of energy in a reversible chemical reaction is tried. It is an advantage of thermochemical heat pumps over the previously used heat pumps that, for maintaining the enthalpy of a chemical reaction, far lower amounts of auxiliary energy are generally needed than for pure compression and/or condensation processes. This means theoretically that thermochemical heat pumps should be capable of higher performance numbers than the known heat pumps operating on a pure physical basis. Heretofore, especially the alkaline earth metal chloride hydrates or ammoniacates have been investigated as reversible chemical reactions. These systems appeared to be interesting especially in connection with the storage of heat such as, for example, solar energy; see DE-OS No. 27 58 727 and DE-OS No. 28 10 360. These systems attained substantially no importance so far since various requirements must be met which are not or only incompletely complied with by these chemical systems:

(1) Full reversibility of the chemical reaction, which is equivalent to long cycle lifetime of the working materials.

(2) As high a reaction enthalpy as is possible associated with the additional requirement that the energy-absorbing process takes place at as low a temperature as is possible (utilization of environmental energy of low energy level) and the energy-yielding process furnishes thermal energy on a temperature level which is sufficient to be capable of operating at least heating installations of buildings.

(3) The course with respect to reaction kinetics must fully satisfy the demands made, i.e. the system must not operate too slowly.

(4) Satisfactory thermal conductivity of the working materials to minimize impediment of the heat exchange process.

(5) Freedom from toxicity of the working materials in order that no health hazards are caused in case of any leakage of the normally fully encapsulated heat pump system.

(6) Reasonable and justifiable price of the working materials.

At temperatures below the freezing point, the rate of dissociation and vaporization of alkaline earth metal chloride hydrates is not high enough. Therefore, they can be operated only with the aid of heat from the ground, from flowing bodies of water or groundwater, which restricts the field of application considerably. In any case, the ambient air which is available to everybody cannot be used as an energy carrier at temperatures below the freezing point.

Moreover, the thermal conductivity of the previously proposed working materials is low so that considerable problems are encountered in the heat exchange processes. At least very large heat exchange surfaces are necessary in case of the previously proposed working materials, which results in units which have an undesirably great volume.

Further substantial difficulties result from mass and energy transport. Thus, the rate of the reaction is decreased to the extent to which anhydrous or ammonia-free salts become coated with layers of salt hydrate or ammoniacate. Distribution of the working materials over a large surface area is unavoidable also for this reason.

In recent years, some metal hydrides have been subjected to closer investigations with a view to use them perhaps for the recovery and storage of hydrogen which can be considered on principle as alternative energy for both engines and heating installations. The hydride formation or hydride cleavage involves a substantial change of enthalpy, which results in considerable difficulties and disadvantages in the case of the intended uses of these metal hydrides. Therefore, the proposal was already made for test vehicles to use the waste heat of the motor and exhaust gases for heating the hydride reservoir. In the summer months, direct air conditioning is possible by heat exchange with the hydride reservoir. On the other hand, great difficulties are encountered in the starting phase because a sufficient hydrogen pressure must be present even at low temperatures to start the motor and bridge over the period of time until the exhaust gases are sufficiently warm to be used for heating the hydride reservoir. Therefore, a combined hydrogen storage system has already been proposed in which tanking-up of the vehicle and heating of the building are combined and the liberated amounts of energy of hydride formation are utilized advantageously; see H. Buchner, Das Wasserstoff-Hydrid-Energiekonzept, Chemie Technik 7 (1978), pp. 371–377. Accordingly, about 30% of the heat content of hydrogen at room temperature can be converted into available heat of higher temperature by hydride formation. Therefore, the recommendation is given to couple always the hydrogen recovery and heat recovery in this process.

As a reversal of this concept, the proposal was also made to store solar heat for air conditioning of buildings by means of metal hydrides. The primary energy source is assumed to be a flat solar collector of about 100° C. and the auxiliary heat bath is assumed to be the ground on a temperature level of about 10° C. As heat accumulator and heat transformation, there are provided two metal hydride reservoirs which contain $CaNi_5$ and $Fe_{0.5}Ti_{0.5}$ powder and between which hydrogen gas can be exchanged by opening a valve. Moreover, heat exchangers connect the two hydride reservoirs with the primary energy source, with the auxiliary heat bath or with the consumer, a building; see H. Wenzl, Wasserstoff in Metallen: Herausragende Eigenschaften and Beispiele für deren Nutzung, Kernforschungsanlage Juelich GmbH, January, 1980, pp. 66, 67 and FIG. 13. However, a rough estimate shows that this concept has not a chance of being realized because it would be necessary to use hydride reservoirs with dimensions which are much too large to be able to serve as storage of solar energy in profitable dimensions.

THE INVENTION

It is an object of the present invention to provide a process and an apparatus for the energy-saving recovery of available heat from the environment or from waste heat with the use of a reversible chemical reaction.

This object is accomplished by charging and discharging alternatingly and successively by pressure variation with hydrogen two vessels which are interconnected by lines and filled with about equal parts of a metal hydride and the hydride-forming metal or the hydride-forming alloy and removing as available heat the heat of compression and of hydride formation thereby liberated by heat exchange and replacing consumed heat of expansion and hydrogen evolution of the hydride by heat exchange with the environment or by waste heat.

According to their porperty of decomposing at lower or higher temperatures, the metal hydrides are classified into low temperature hydrides and high temperature hydrides. Especially if heating of buildings with ambient heat is concerned, actually only low temperature hydrides are considered. On the other hand, if waste heat from power stations or industrial plants is desired to be utilized, the high temperature hydrides suggest themselves. Especially iron titanium hydride is suitable for heating dwelling houses. This hydride is capable of being rapidly formed and cleaved again in the range from −20° to +70° C., the pressure range of 0.1 to 12 bars being completely sufficient to control the formation and cleavage. The high rate of the reaction, the high metallic thermal conductivity of the metal hydrides and the long cycle lifetime of metal/metal hydride and the high energy density permit the use of this metal hydride provided that it is possible to seal the system hermetically and avoid especially the access of oxygen. This problem is substantially alleviated if the heat pump process is carried out according to the absorption principle so that a leakage-sensitive suction/-pressure pump can be dispensed with. Moreover, the price of this alloy when purchasing larger amounts has already dropped to DM 10.00 per kilogram so that the installation cost of a household heating system based on this metal hydride may be substantially lower than that of conventional heat pumps.

It is a further advantage of the metal hydrides that they have been found to be absolutely safe and non-toxic so that expensive safety measures need not be taken. For example, for a building heating system, it will be completely sufficient to connect the system with a safety valve and a line leading to the outside so that, for example, in case of a fire and the associated overheating of the system, the hydrogen can be safely vented to the outside where, due to the low specific density, it is immediately distributed upwardly into the atmosphere and represents no longer a source of hazards.

Figure 1:
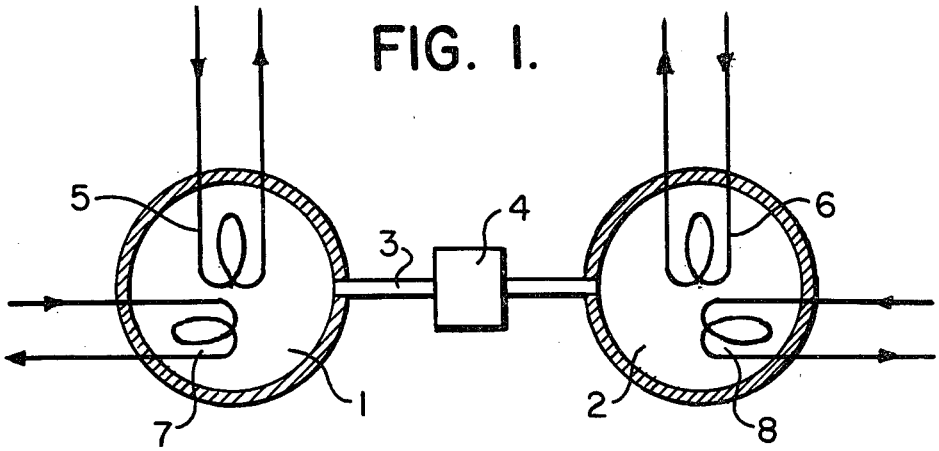
FIGS. 1–4 are schematic drawings of different embodiments of the apparatus for carrying out the process of the present invention.

However, when using the metal hydrides in accordance with the invention, attention is to be paid to a number of other problems. For example, as little as traces of oxygen result in deactivation of the metal hydrides so that the reversible hydride formation is substantially affected or comes to a complete standstill by as low as small amounts of oxygen. Therefore, referring to FIG. 1, it is absolutely necessary that the total system comprising the two vessels (1) (2), the reversible line or pipe system (3) and the suction/pressure pump (4) is hermetically sealed from the environment. Since most of the metal hydrides can be reactivated with pure hydrogen at elevated temperatures, this part of the apparatus according to the invention should be capable of being readily dismantled and transported to be able to replace and regenerate it in case of a trouble or breakdown by penetrating oxygen. The metal hydride also could be protected by oxygen absorbing materials like chromium troxide on silica gel (Oxisorb, Messer Griesheim).

To carry out the heat exchange on the metal hydride reservoirs at a high rate and with low losses, large area contact with the two exchanger systems (5), (6), (7) and (8) should be possible. On the other hand, the mass of the jacket and of the heat exchangers should be kept small since otherwise the heat capacity of these parts becomes unnecessarily high and substantial delays and heat losses would occur when reversing the system. Therefore, the vessels (1) and (2) are preferably constructed as batteries of pipes which are connected with the pipe system (3). To permit rapid entrance and rapid removal of the hydrogen from the metal hydrides in the interior of the pipes, it may be advantageous in certain cases to introduce spider-shaped pipe inserts with sieve-like closed holes into the metal hydride tubes. Since the metal hydrides after usual activation by hydrogen have generally the form of large surface area fine grained powders, additional inserts of this kind can be dispensed with in case of pipes of smaller size.

In the most simple case, the heat exchange on the metal hydride reservoirs (1) and (2) may be effected with air. In case of a heating system for buildings, warm air would be directly withdrawn from the system and could directly serve for heating the rooms of a building. If desired, this stream of warm air could be metered such by means of a mixing valve and a thermostat that the room temperature remains constant.

A heating system of this type would exhibit the following cycles:

(a) Hydrogen is pumped from the reservoir (1) to the reservoir (2). Metal is formed again from the hydride in the reservoir (1) while hydride is formed in the reservoir (2). The liberated heat in reservoir (2) is directly removed as available heat by the heat exchange. As soon as substantially all of the hydride in the reservoir (1) has been converted into metal and the metal in reservoir (2) has been converted into the hydride, no further heat is liberated in reservoir (2) so that the system must now be reversed.

(b) By pumping the hydrogen back from reservoir (2) into reservoir (1), the reaction of hydride formation is reversed so that heat is now liberated in reservoir (1). Of course, no useful heat will be obtained briefly after reversing since, by heat exchange with the environment, reservoir (1) will have as a maximum the ambient temperature and must first be correspondingly heated by hydride formation until the temperature has increased to the level desired. This reversing or switching phase will be the longer the higher the heat capacity of the system and the higher the difference between the temperature of the available heat and the ambient temperature. The useful or available heat should not be withdrawn before the reservoir (1) has reached or exceeded the temperature of the available heat.

In order that the stored heat present in reservoir (2) at the time of reversing or switching is utilized judiciously, it should either be used to prepare service water or preheat the reservoir (1) by heat exchange with reservoir (2) until the equilibrium temperature has been established.

Since most of the heating systems operate with circulating water, the heat exchange of the available heat may also be effected directly with water. However, since the vessels in the phase of hydrogen delivery drop to temperatures of less than 0° C., this would result in freezing of the water. Thus, if the heat exchange is desired to be effected with water, this would have to be effected by irrigation of water over the pipe batteries. The water having been heated correspondingly would then have to be returned into the cycle by an additional pump. During the reversing or switching phase, heat exchange could again take place between the reservoirs (1) and (2) or service water could be preheated. The heat exchange with the environment would in turn have to be effected by means of air or a liquid system with antifreezing compound. When effecting the heat exchange with air, cooling of the air must always be expected to result in formation of condensation water and ice, which detrimentally affects the efficiency of the system considerably. The latent heat of melting and evaporating water increases indeed in an undesirable manner the heat capacity of the system, which results in time and energy losses in the reversing or switching phase. These disadvantages are avoided when using water and aqueous cooling media containing antifreezing compound. On the other hand, the expense of apparatus is correspondingly higher in the latter case.

Herefore, a preferred variant of the process according to the invention uses for the heat exchange what is known as heat pipes (see P. Dunn and D. A. Reay, Heat Pipes, Pergamon Press, 1976). These are hermetically sealed metal pipes which are partially filled with a readily vaporizable liquid. The heat transfer is effected by evaporation of the liquid at the lower end and delivery of evaporation heat by recondensation of the liquid at the top of the pipe. These heat pipes act as diodes since heat can always be transferred only in one direction, i.e. from the bottom to the top. If the amount of heat at the lower end is no longer sufficient for evaporating the liquid, no more vapor is able to rise and condense at the top. Thus, as soon as the top has a higher temperature than the lower end, no more heat transportation takes place. Additionally, these heat pipes have the advantage that the thermal conductivity is higher by three powers of ten than that of copper.

Therefore, when using heat pipes of this type in the process according to the invention, reversing or switching of the heat exchanger systems becomes unnecessary because the heat pipes always are only able to transport the heat in the one direction desired. In such a case, it is only necessary to reverse the direction of the hydrogen stream through the pump (4). This may be effected by means of appropriate valves or by reversal of the direction of rotation of the pump. In case of the absorption heat pump, reversal of the direction of flow of hydrogen is effected by simple connection and disconnection of the fossil heating source as determined by the time of the working cycle.

Thus, while each phase reversal in cases where heat exchange is effected with air, water, antifreeze-containing water or other liquids also requires reversal of the corresponding heat exchangers, which requires a substantial expense of apparatus and appropriate control devices, this can be dispensed with when using heat pipes. Reversal of the direction of pumping the hydrogen may be effected in case of this preferred embodiment of the invention by thermostats or even by a simple timer. The recovered useful heat may, due to the diode effect of the heat pipes, flow always only in the direction desired so that a phase-inverted reversal or switching can never occur. Of course, it is unavoidable even when using heat pipes that, after reversal or switching-over, no useful heat can be withdrawn initially for some time since the cooled vessel must, by hydride formation and, if necessary of desired, heat exchange, first be brought to the temperature of the useful heat to be withdrawn.

In a further embodiment of the invention, the pressure change is effected thermally, While this obviates the use of the suction/pressure pump, it is necessary to use two different metal hydrides. The two metal hydrides must differ by different hydrogen absorption or desorption energy and, therefore, absorb or deliver the hydrogen at different temperatures. The metal hydride having the lower hydrogen desorption energy is capable of utilizing ambient heat or waste heat while the second metal hydride having the higher hydrogen desorption energy must be fed with heat as it may, for example, be recovered by combustion of fossil fuels.

A typical combination of two different metal hydrides is represented by a titanium-iron-manganese hydride and a titanium-ziroconium-chromium-manganese hydride. The chemical composition of these hydrides is $TiFe_{0.8}Mn_{0.2}H_2$ and $Ti_{0.9}Zr_{0.1}CrMnH_3$, respectively.

The absorption and desorption temperatures of these two metal hydrides are +65° C. and +121° C. and −6° C. and +50° C., respectively. A theoretical system performance number of 1.6 can be calculated herefrom.

Figure 4:
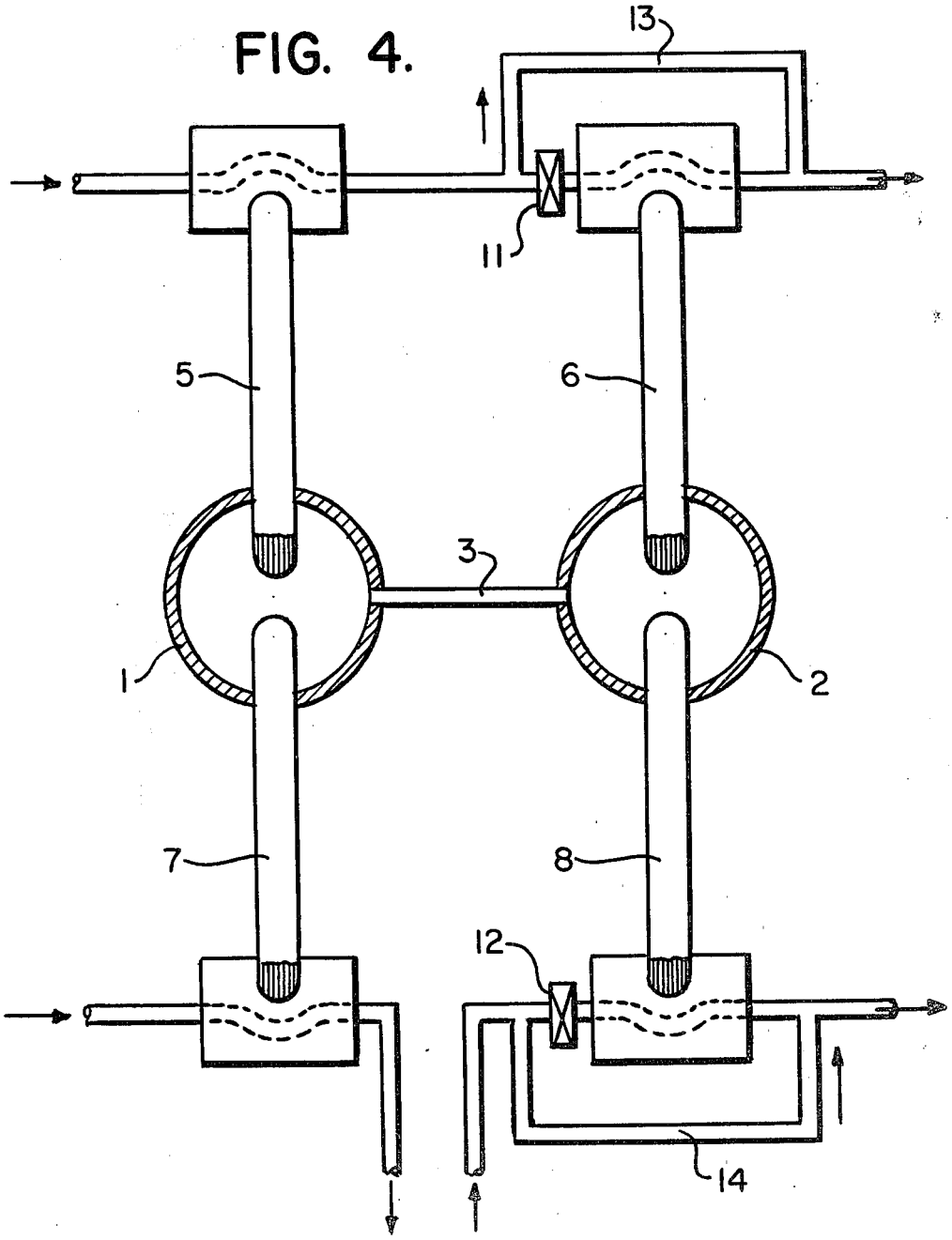

An apparatus for carrying out this variant of the process as shown in FIG. 4, also comprises two reservoirs (1), (2) each of which is filled with about one half of each the metal hydride and the hydride-forming metal of the two different metal hydrides, a connecting pipe (3), alternatingly reversible heat exchangers (5), (6) for the removal of the available heat and alternatingly reversible heat exchangers (7), (8) for the supply of ambient heat or waste heat or the fossil heat, and line (13), (14) and reversible gate valves (11), (12).

The use of heat pipes is particularly advantageous also for this purpose. While the heat pipe (7) is fed now as before with ambient heat or waste heat, the heat pipe (8) is fed intermittently with heat which has been generated by combustion of fossil fuels. The additional line (13), (14) and reversible gate valves (11), (12) are necessary to prevent direct retransmission of the heat generated from fossil fuel to the stream of useful available heat. This would be prevented by putting out of operation the heat exchanger of the heat pipe (6) during the period of hydrogen desorption by by-pass conduction of the stream of useful heat. This is effected by correspondingly operating the gate valve (11).

While the heat pipe (6) is out of operation, accumulation of heat occurs in that proportion of the stream which entrains useful heat and which is retained in the heat exchanger. This has the desirable result that the medium transporting the heat is superheated in the heat pipe and is converted almost completely into vapor of poor thermal conductivity without the possibility of condensation. This reduces largely the heat transfer to the heat exchanger at the top of the heat pipe. It would be possible on principle to install a second gate valve also into the by-pass line, this gate valve opening or closing the by-pass line in push-pull operation. However, such an arrangement requires an additional expense for control.

Similarly, it is necessary to install in the feed line of heat generated by fossil fuel to the heat pipe (8) a by-pass line (14) and a gate valve (12). However, if the measure of supplying by a liquid medium the heat generated by combustion of fossil fuels is not used, this installation can be dispensed with completely provided that an intermittent direct heating is used. In practice, this is achievable in a particularly simple and easy manner by an appropriately controlled oil or gas burner. In this case, a unit comprising three heat pipes, i.e. (5), (6) and (7), would be sufficient.

If necessitated by the particular intended use of the useful heat that it can be withdrawn continuously, it is necessary to transfer the useful heat either partially into a heat accumulator such as a Glauber's salt heat accumulator or to use in parallel connection two apparatus according to the invention and withdraw from them the useful heat with phase displacement. The cycle of such a double system would then, for example, proceed according to the rhythm (1), (1'), (2), (2'), (1), etc. However, for the normal heating of a building, it is readily acceptable that no useful heat can be withdrawn for some time after each reversal, especially if these phases in which useful heat is not made available are relatively short.

The dimensioning of the apparatus according to the invention and the duration of the respective phases are dependent to a considerable extent on the amounts of the needed useful heat which is available and on the cost of the installation. Thus, when using ambient air, it certainly would be practical to have only one cycle proceed per day because then the day air which always is somewhat warmer would be utilized. However, the cost of installing the unit and the needed amounts of metal hydride would be considerably higher in this case. According to the invention, it is possible and extremely advantageous to operate with substantially shorter cycles of, for example, 30 minutes to 3 hours thereby reducing substantially the size and investment sum of the unit. It is well possible theoretically to reduce the cycles still more, e.g. to 10 minutes, but this would no longer reduce the investment cost proportionately to such a large extent. Moreover, the kinetics of hydride formation would make itself already conspicuous in a troublesome manner in case of still shorter cycles.

The dimensioning results from the following rough estimate: In case of a maximum heat requirement per heating day in a one-family house of 100 kw, a reaction vessel would have to contain at least 3,000 kgs. of metal or metal hydride. When reducing the time of the individual phases to one hour, the requirement of hydride drops already to 125 kgs. per vessel. Thus, on the basis of the price previously mentioned of about DM 10.00 per kg., the investment sum is reduced to less than that of conventional heat pumps, the higher efficiency and the less troublesome use of ambient heat permitting an almost universal use at least in those degrees of latitude where the outdoor temperatures drop seldom to below −10° C.

The process according to the invention and the apparatus according to the invention can be used with particular advantage at places where larger amounts of waste heat are available at a relatively low temperature level such as, for example, cooling water or condensates from power stations, steel works, coke-oven plants, chemical plants, etc. These amounts of heat can be transmitted in a relatively simple manner and with low losses over long distances and can be converted according to the invention into useful heat of higher temperature at the particular places of consumption. For example, it is conceivable only in this maner to operate long-distance heat pipelines at relatively low temperatures and withdraw heat of the higher temperature desired only in the households or at the places of consumption. Thus, the apparatus according to the invention is used like a heat transformer. In contrast to electric energy which can be transmitted over long distances with low loss only if the voltage is high, heat can be transported in a pipeline system if the temperature differences to the environment are low.

It is apparent from these statements without the necessity of further differentiation that the heat pump variants according to the invention may also be used for cold production or refrigeration. Especially the absorption heat pump would be suitable for solar cooling because the upper temperature level for conducting the process is already in the range of the output capacity of non-concentrating solar collectors when selecting corresponding metal hydrides.

The principle and preferred embodiments of the apparatus according to the invention are illustrated hereafter in greater detail with reference to the drawings.

Figure 2:
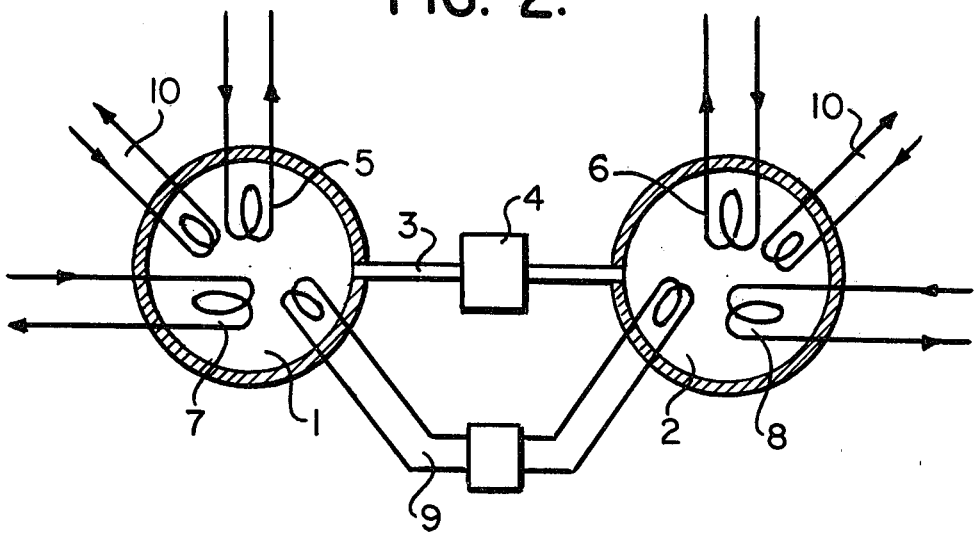

FIG. 2 shows an embodiment where, after changing-over, heat exchange is additionally possible between the reservoirs (1) and (2) by means of the device (9) and, if desired, additional heat exchangers (10) are provided which permit the removal of useful heat of lower temperature, e.g. for preheating service water.

Figure 3:
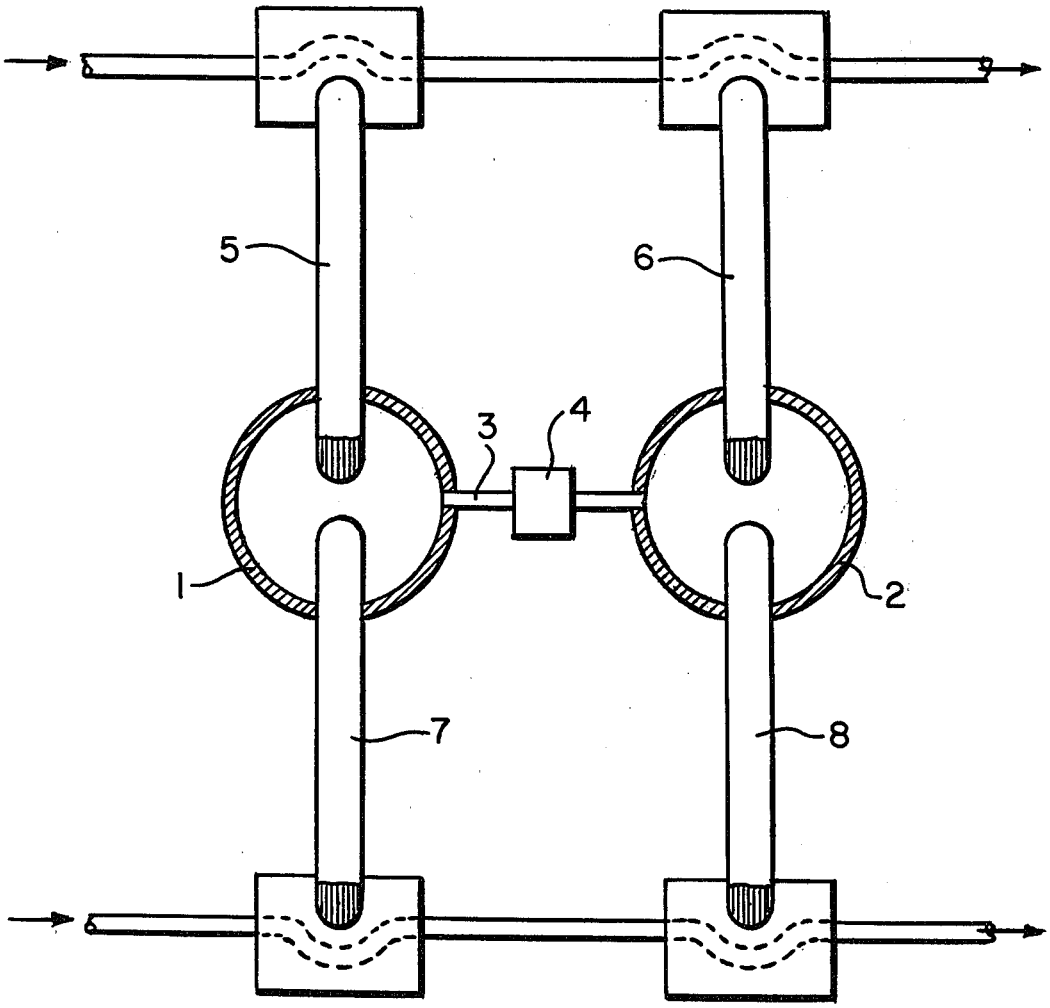

FIG. 3 shows a preferred embodiment where heat pipes are used for both the supply of ambient heat and for the removal of the useful heat and where no reversals are necessary because of the diode effect.

FIG. 4 shows a further embodiment where heat pipes are used and where the change of pressure is effected thermally.

In all drawings, (1) and (2) represent the reservoirs which are filled with metal and metal hydride, respectively;

(3) is the reversible pipeline system for hydrogen;

(4) is the pump for hydrogen which, if desired, may be reversed;

(5) and (6) represent the reversible heat exchangers for the useful heat;

(7) and (8) represent the reversible heat exchangers for ambient heat and waste heat, respectively;

(9) is a heat exchanger between the two reservoirs (1) and (2) which may be used after change-over;

(10) represents additional heat exchangers for removing useful heat energy of lower temperature, e.g. for preheating service water;

(11) and (12) are gate valves which permit intermittent discontinuation of the withdrawal of useful heat or supply of fossil heat;

(13) and (14) are by-pass lines for withdrawing useful heat or for supplying fossil heat which may, if desired, be switched by further gate valves (not shown) in an alternating rhythm with the gate valves (11) and (12).

What is claimed is:

1. A process for the energy-saving recovery of useful heat from the environment or from waste heat with the use of a reversible chemical reaction of the formation and decomposition of metal hydrides, comprising the steps of: providing two vessels interconnected by lines and which are filled with about equal parts of a metal hydride and the hydride forming metal or the hydride forming alloy, alternatingly and successively charging and discharging the vessels with hydrogen by pressure variation and exchanging the heat of compression and the hydride formation, removing the useful heat and replacing consumed heat of expansion and hydrogen evolution of the hydride by heat exchange with the environment or by waste heat, wherein the heat exchange removing useful heat and the heat exchange with the environment or waste heat is conducted by heat pipes which transfer heat only in one direction.

2. A process according to claim 1, wherein a low temperature hydride is used as the metal hydride and the pressure variation is effected mechanically.

3. A process according to claim 1, wherein iron-titanium hydride is used as the metal hydride.

4. A process according to claim 1, wherein two different metal hydrides are used and the pressure variation is effected thermally.

5. A process according to claim 4, having a titanium-iron-manganese hydride and a titanium-zirconium-chromium-manganese hydride are used as metal hydrides.

6. A process according to claim 1, wherein the heat exchange is effected with air/air.

7. A process according to claim 1, wherein said heat exchange is effected by irrigation of water over a battery of pipes and, on reversal, the heat capacity of the system by irrigation with cold fresh water is used for preheating warm service water.

8. A process according to claim 1, wherein two systems of the same size are connected in parallel and reversed with phase displacement of removing useful heat.

9. An apparatus for the energy saving recovery of useful heat from the environment or from waste heat which comprises at least one system comprising: two reservoirs which have about the same size and each of which is filled with about one half of metal hydride and one half of the hydride-forming metal or the hydride-forming alloy; pressure varying means for alternatingly and successively charging and discharging the two vessels with hydrogen and means for removing the useful heat and replacing consumed heat of expansion and hydrogen evolution of the hydride by heat exchange with the environment or by waste heat comprising heat pipes which transfer heat only in one direction for removing the useful heat and for conducting waste heat for the heat exchange with the environment.

10. An apparatus according to claim 9, wherein the two reservoirs are each filled with about one half of each of the metal hydride and the hydride-forming metal of two different metal hydrides; wherein the pressure varying means comprises means for thermally effecting pressure variations; and means for supplying fossil heat including at least one line and reversible gate valve connected to the heat pipes for preventing direct retransmission of the heat generated from the fossil fuel to the stream of useful heat.

11. An apparatus according to claim 10, comprising an intermittent direct heating system for supplying the fossil heat.

12. An apparatus according to claim 9, wherein two systems having almost the same size are connected in parallel with phase displacement for removing the useful heat.

* * * * *